US005516114A

United States Patent [19]

Michlin et al.

[11] Patent Number: 5,516,114

[45] Date of Patent: May 14, 1996

[54] JUMPERTOPS CLIPPER DISK GAME PIECE AND GAME

[75] Inventors: Spencer Michlin; Mark A. Celeste; Mark Domiteaux, all of Dallas, Tex.

[73] Assignee: Lulirama, Inc., Dallas, Tex.

[21] Appl. No.: 395,318

[22] Filed: Feb. 28, 1995

[51] Int. Cl.[6] ..... A63F 9/02; F41J 1/00

[52] U.S. Cl. ..... 273/400; 24/30.5 S; 24/67.9; 24/545; 24/DIG. 9; 273/424; 273/428; D19/65

[58] Field of Search ..... 273/400, 424, 273/353, 428; 24/545–547, 570, DIG. 8–10, 67.9, 30.5 S; D19/65

[56] References Cited

U.S. PATENT DOCUMENTS

| | | | |
|---|---|---|---|
| D. 332,220 | 1/1993 | Specht et al. | D19/65 X |
| 2,341,121 | 2/1944 | Schaaff | 24/67.9 X |
| 2,590,166 | 3/1952 | Farrell | 24/DIG. 9 X |
| 2,609,629 | 9/1952 | Hubbard | 24/DIG. 9 X |
| 3,822,441 | 7/1974 | Paxton | 24/30.5 S |
| 3,959,915 | 6/1976 | Kettlestrings . | |
| 4,011,673 | 3/1977 | Levine | 24/67.9 X |
| 4,030,760 | 6/1977 | Danowski . | |
| 4,261,135 | 4/1981 | Lehman . | |
| 4,325,556 | 4/1982 | DeCanto et al. . | |
| 4,354,326 | 10/1982 | Mathews . | |
| 4,361,935 | 12/1982 | Paxton | 24/30.5 S X |
| 4,877,256 | 10/1989 | Falloon . | |
| 5,110,139 | 5/1992 | Baumbartner . | |
| 5,231,735 | 8/1993 | Paxton | 24/30.5 S |
| 5,318,307 | 6/1994 | Bouchard et al. . | |
| 5,340,113 | 8/1994 | Respicio . | |

FOREIGN PATENT DOCUMENTS

| | | | |
|---|---|---|---|
| 76132 | 4/1983 | European Pat. Off. | 273/353 |
| 716047 | 1/1942 | Germany | 24/67.9 |
| 3345 | of 1905 | United Kingdom | 273/353 |

*Primary Examiner*—Paul E. Shapiro
*Attorney, Agent, or Firm*—Charles C. Garner

[57] ABSTRACT

A game board and plurality of game pieces, are provided, called "jumpertop clipper disks". A jumpertop clipper disk is fun because it may be jump-flighted by flexing it between thumb and forefinger, aiming, and quick-releasing, so that it will jump forth as an aimed, self propelled projectile, toward positively scored targets and negatively scored hazards. This requires skill in aiming and quick-releasing to hit targets and avoid hazards. Clipper disks may be decorated with indicia and logo. They may be clipped onto clothes, hair, school books, and personal effects as decorations. They may be linked, one to another, to form a chain of identifiable, collectible disks, for team identity. Score is kept for each jump-flight. The highest net score for player or for team, is the winner.

13 Claims, 5 Drawing Sheets

JUMPERTOPS CLIPPER DISK GAME PIECE AND GAME

TECHNICAL FIELD

This invention relates to games and game pieces used in board or table games, and more particularly to a board game in which the game piece is manually launched toward scored targets and hazard areas for highest net total score.

BACKGROUND OF INVENTION

Mankind continues to be fascinated with the play of personal games, and particularly those involving manual skill and competition. Table games have been found in earliest cultured civilizations such as the Egyptians, Greeks and Romans, and in primitive civilizations as well. Games have ever been a part of developed societies. Such games have ranged from dice to dominoes, from backgammon to tiddlywinks, from shuffle board to hoops, to washers, to horseshoes. The love of games based on skill of hand and quickness of eye is universal.

One of the most popular game fads of the decade has been one called POGS, which evolved in Hawaii from the popularity of collecting milk caps, i.e. coin sized disks each bearing an identifiable color and indicia on a face thereof. Collectable milk caps, or so-called cap mans, or Pogs, of different sizes and shapes, colorfully decorated with logos of popular characters, evolved into a collection craze and into the play of the lighter player disks being struck by the heavier, hitter disks, in which a quantity of player disks are arranged in a vertical stack with faces down, and players take turns throwing the heavier hitter disk toward the stack, knocking the stack over and toppling the player disks, in which some of them will be turned over with face up, with the number of player disks turned over in a single hit providing the winning score. From this developed various games using the POGS hitter disk as the chance determining device. In variations, there evolved player disks with a centrally depressed area concentrically formed in the center portion of the top face of a disk body, in which the stack of disks with central depressions provide compressible air pockets between disks which are violently depressed when the stack is struck by the impact of a hitter disk, providing expansion immediately thereafter which projects and propels the upper player disks upward, over and away from the stack.

In the play of games, there is ever the search for novelty in skills and competition. Old games remain as favorites, but there is a universal fascination and desire for novel games in which manual player skill is exhibited.

SUMMARY OF THE INVENTION

Despite the fantastic popularity of Pogs, it is recognized that relatively little player skill can be developed or employed in the throw of a hitter disk against a stack. An objective of the instant invention is to provide a novel game of skill wherein a collectible player disk can be skillfully aimed and caused to jump-fly toward selected targets. An objective of this invention will be to provide a novel, collectible, jump-flying game disk which may be employed for various utilities, decorations, adornments, and other collectible attributes and fascinations, while providing a game of manual skill in which the more dexterous and skilled player can demonstrate his prowess and win the game.

This invention provides a board game with a plurality of game pieces adapted to jump-fly into target areas of the game board when skillfully flexed, aimed and quick-released between thumb and forefinger, for highest target score; and the game piece further comprises means for clipping said piece onto clothes, hair, school papers, books, and other personal effects so that it may be worn and used for game identity and adornment: and further comprises means for linking one piece to another to form a chain; and likewise comprises means for employment for game identity and decoration of notebooks, papers, school paraphernalia, and other personal articles of the game player for team recognition. The game board provides a selection of launch pad areas from which individual jump-flights of game pieces may be directed toward positive targets and negative hazards.

BRIEF DESCRIPTION OF THE DRAWINGS

An understanding of the Invention can be had by referring to the accompanying drawings, in cooperation with the later following Detailed Description, wherein:

In FIG. 4, the jumpertops clipper disk 10 is employed as a paper clip 10 to be clipped onto paper 21.

FIG. 5 shows the clipper disk 10 of this invention clipped onto clothes 22 of the player as decoration or adornment of clothes 22 of a game player, in two alternate, equivalent utilities, being clipped onto the pocket of a player's shirt 22, and equivalently clipped onto the sleeve.

In FIG. 6, the jumpertops clipper disk 10 is illustrated in utility as a hair clip 10, in which the disk is fitted onto the hair 23 as a hair clip 10, first slipping the wings 14 of the jumpertops clipper disk 10 under a lock of hair 23, and then slipping the lock of hair 23 over the pointer 15, and may be done equivalently in the opposite arrangement.

In FIG. 7, a quantity of jumpertops clipper disks 10 are linked together as a chain, in which the wings 14 and pointer 15 of a second disk 10 are linked into and over a first disk 10; and the wings 14 and pointer 15 of a third disk 10 will be linked into and over the second 10; and so on in sequence until a chain is formed, as shown in FIG. 7, and may be done equivalently in the opposite arrangement.

DETAILED DESCRIPTION

Figure 1A:
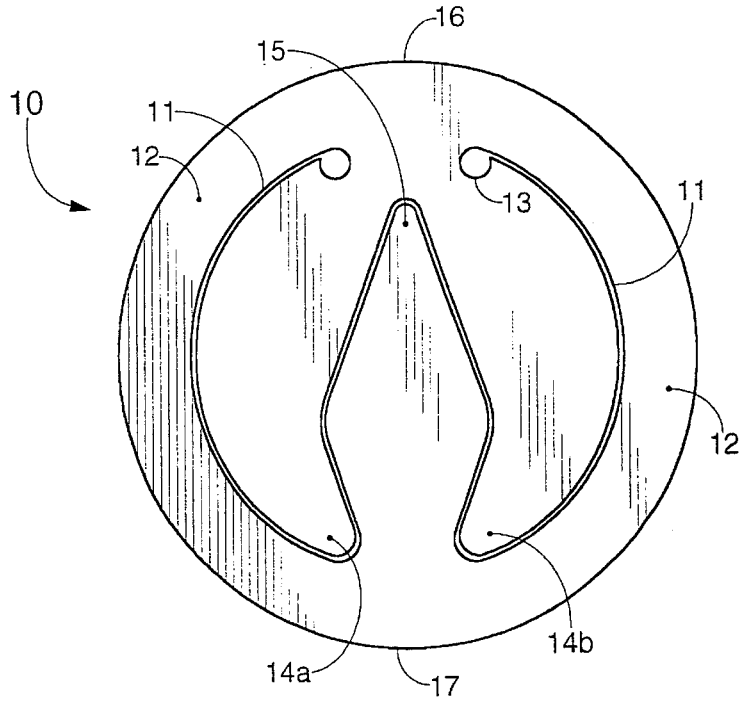
In FIG. 1*a*, there is an enlarged scale plan of a game piece 10 of this invention known as the jumpertops clipper disk.

To follow the detailed description, please refer to the accompanying drawings, wherein like reference numerals designate like or corresponding parts throughout the several views.

Paraphernalia of The Game

The game is played with one game board 80 and a set of one or more jump-flight clipper disks 10 for each player, preferably a plurality of ten (10) disks 10 per player. The game board 80 will have one or more launch pads 81, an array of targets 82, being equivalently target areas, cups or compartments, and likewise an array of hazards 83. The jump-flight clipper disks 10 are used as jump-flying game pieces 10 as in FIGS. 2*d* and 3*d*, launching each disk 10 into preferred positive target areas 82, avoiding undesirable negative hazard areas 83, to achieve the best net total score. Jump-flight clipper disks 10 are employed as adornment of player clothes, hair, school books, school paraphernalia, and the like as in FIGS. 4–7, and for player identification and team recognition.

Figure 1B:
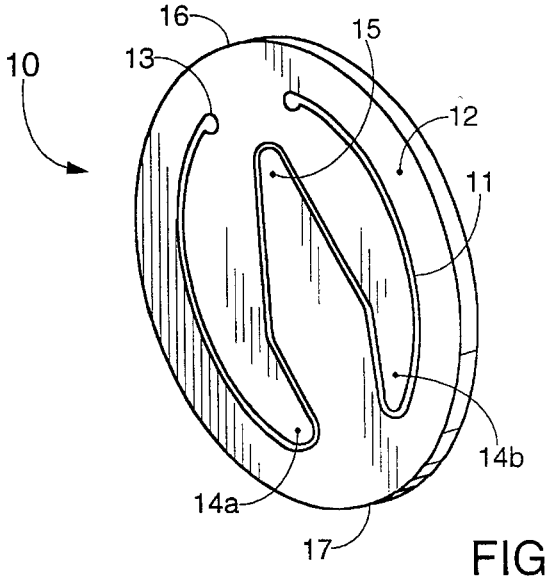
FIG. 1*b* shows a perspective view, to approximate true scale, of the clipper disk 10 of FIG. 1*a*.
Figure 1C:
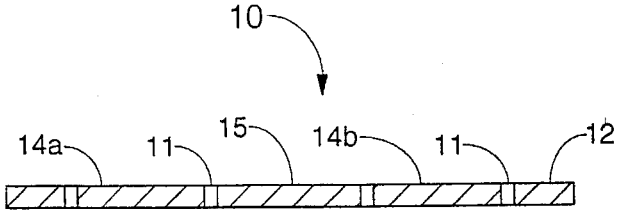
FIG. 1*c* is a cross-section, end view of the clipper disk 10 taken at a horizontal centerline of FIG. 1*a*.

To effect jump-flight characteristics, a clipper disk 10 will have a pattern cut-out 11, cut through the face to the back side of the disk 10, but in which the cut 11 is contained within the interior of the disk 10 and does not cut through the periphery, thus retaining the continuity of the outside circumference. In the preferred embodiment, there will be left remaining an uncut band or border 12 about the disk 10 that is about one-sixth of the disk diameter. In the preferred embodiment, the ends of the cuts or grooves which form the cut-out pattern 11 are each terminated by a small hole 13 for minimizing stress concentration, approximately 0.08" inches in diameter, as seen in FIG. 1.

The pattern 11 may be of varying design, but in the preferred embodiment, will be in the approximate shape of the letter "W", forming two wings 14*a* & b and a pointer 15. When the top edge 16 of the disk 10 is bent backwards between the thumb and finger, pulling the top edge 16 toward the bottom edge 17, the central portion of the W will be forced to protrude forward forming, in the upper half, the shape of two wings 14*a* & b extending outwardly and downwardly, and in the lower half, the shape of a pointer 15 extending outwardly and upwardly. The pointer 15 will be used to aim the direction of flight.

A jump-flight clipper disk 10 is generally coin shaped, being preferably substantially round, and equivalently may be octagonal, hexagonal, or any generally coin shaped disk, similar in size and shape to a pokerchip, except the disk will be flexible and resilient for jump-flight, being approximately 0.040 inches thick, more or less, depending on flexibility of the material. The two faces of the disk 10, while generally flat and substantially parallel, may optionally contain concave recessed, or centrally depressed areas, or may be contoured for decorative purposes. Depressions will also be found to vary the jump-flight characteristics and gamesmanship in play of the game, and thus may be especially fabricated in contoured configuration if so ordered by the players.

In play, it has been found that the preferred diameter-to-thickness ratio of the jumpertops clipper disk 10 will be within a range of about 35 to 50. That is to say, the diameter of the jumpertops clipper disk will generally be about 35 or more times greater than the thickness of the material from which the disk is made.

In a preferred embodiment, a jumpertops clipper disk 10 is about 1.625 inches in diameter and about 0.040 inches thick. It may be made of any flexible, resilient material, similar to that from which commercial credit cards are made. In a preferred configuration, the disk is made of plastic; but may equivalently be of any selected resilient material having the desired flexibility and resilience to achieve good jumpertops jump-flight characteristics.

The face of each jumpertops clipper disk 10 may display that player's game and team indicia. Equivalently the face may be colorfully decorated with logo of famous characters. The cut-out pattern may be standardized for flight characteristics, but in some teams, the cut-out may be especially designed on special order of the players to achieve different flight techniques.

Game Board

The game board 80 is a planar area on which is mounted the following:

one or more horizontal designated launch-pad-areas 81 from which jump-flights of disks 10 will be selectively launched, depending on choice of the player;

an array of one or more positive targets 82; and an array of one or more negative hazards 83.

The launch-pad-areas 81 will be marked with a designated multiplier for each launch-pad 81, signifying the multiplier of score to be achieved for each jump-flight from that launch-pad 81.

The positive targets 82, and likewise the negative hazards 83, will be marked with the score to be achieved, positively and negatively, respectively, for acquisition of that particular target on a jump-flight. The sizes and shapes of the targets 82, and likewise the hazards 83, may be varied. The smaller targets, being more difficult to hit, would be scored higher than the larger targets.

Figure 8A:
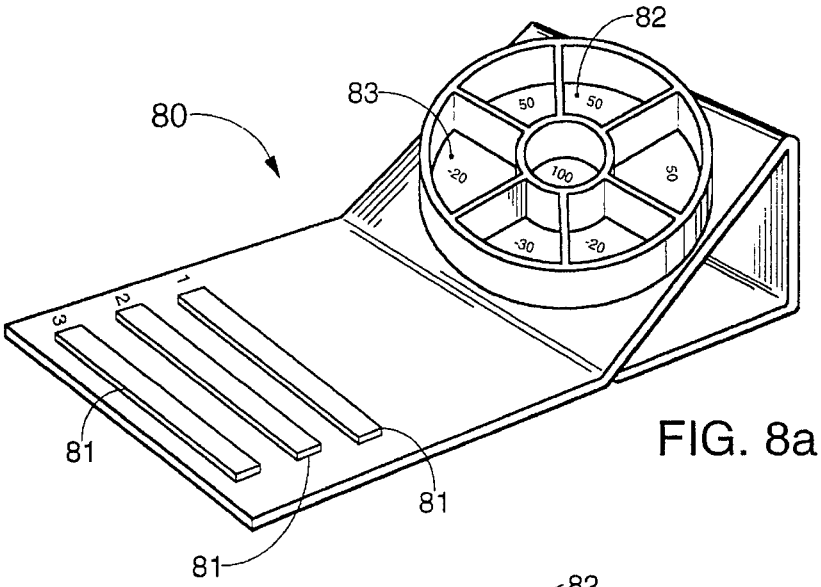
FIG. 8*a* shows a perspective view of the preferred embodiment of a game board 80 of this disclosure, with launch pad areas 81, in which the target 82 and hazard 83 area is inclined at an angle from the horizontal.
Figure 8B:
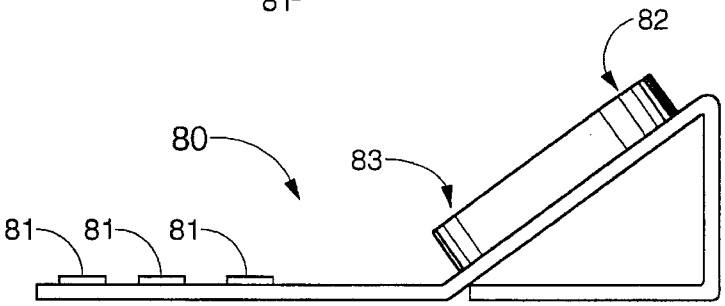
FIG. 8*b* provides a side view of the same game board.
Figure 9A:
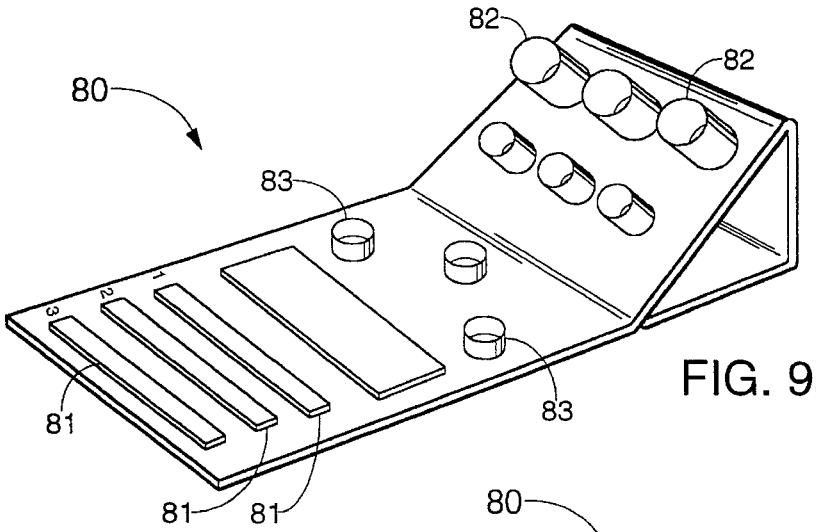
FIGS. 9*a* and 9*b* shows a perspective view and side view, of an example of one of the many equivalent, alternate game boards 80 within the purview of this disclosure, in which each would provide alternate launch areas 81, and an array of positive targets 82, and an array of negative hazards 83.
Figure 9B:
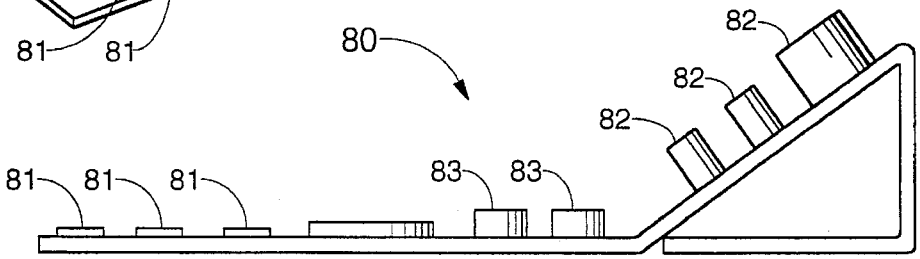

The target 82 and hazard 83 area will preferably be located on a portion of the game board which can be raised at an angle from the horizontal, to present an angular surface of targets and hazards towards which jump-flights are launched. The game board preferably will be portable, being appropriately foldable as in FIGS. 8 & 9 and adapted for ease of erection for play of the game.

"Jumpertops Jump-Flight"

Figure 2A:
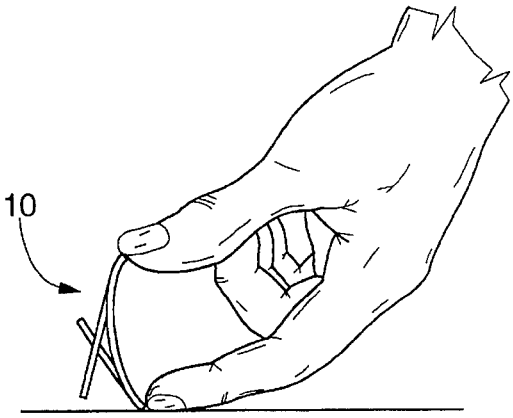
FIGS. 2*a* through 2*d* show sequential illustrations of how the jumpertops clipper disk 10 is held between the thumb and forefinger, and the sequence of steps used to make the jumpertops clipper disk 10 jump-fly by flexing, aiming, and quick-releasing the jumpertops clipper disk between thumb and forefinger. Notice in FIGS. 2*a* through 2*c*, the hand is positioned with the forefinger placed on the table top surface and the thumb is the upper digit at the top of the jumpertops clipper disk 10.
Figure 2B:
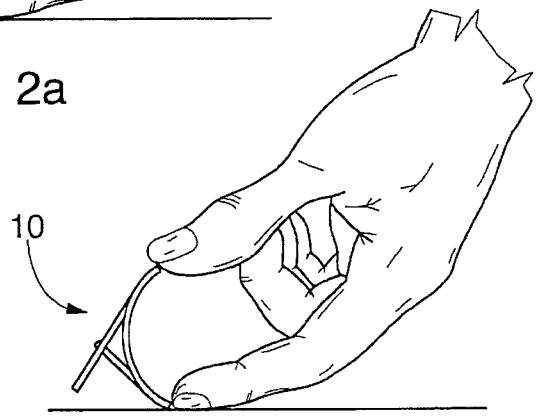
Figure 2C:
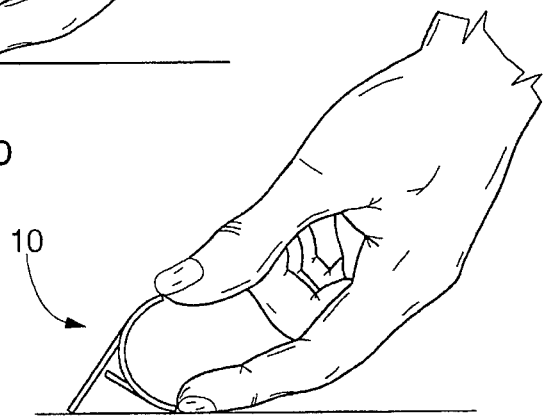
Figure 2D:
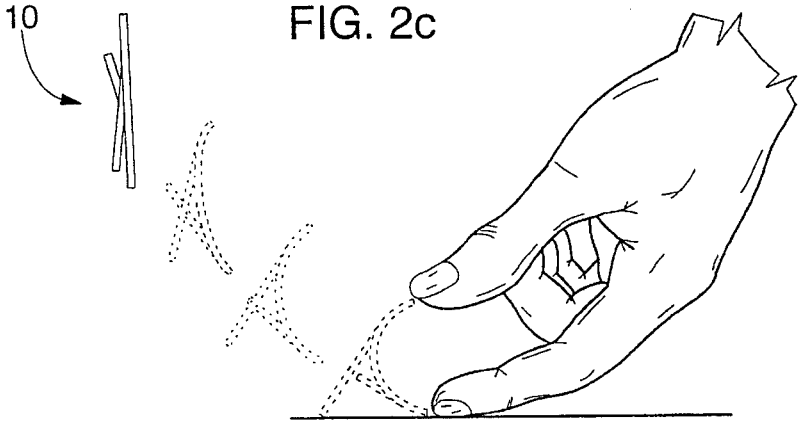
Figure 3A:
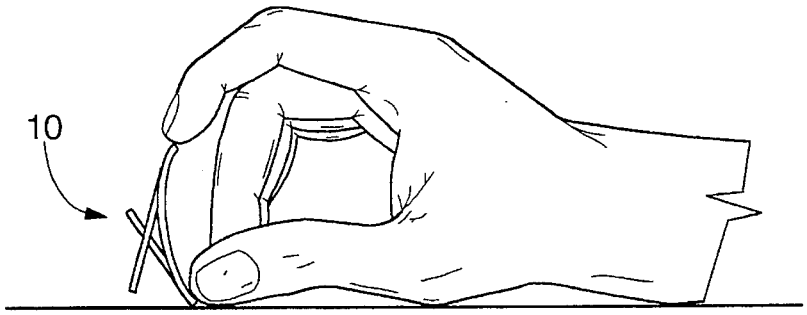
In FIGS. 3*a* through 3*d*, the hand is reversed, with the thumb placed on the table top surface while the forefinger is the upper digit, being an equivalent option at the choice or agreement of the players that the thumb may be equivalently in the up position or down. Likewise it is equivalently at the agreement of the players that any finger may be substituted and used for jump-flight launching in lieu of the forefinger.
Figure 3B:
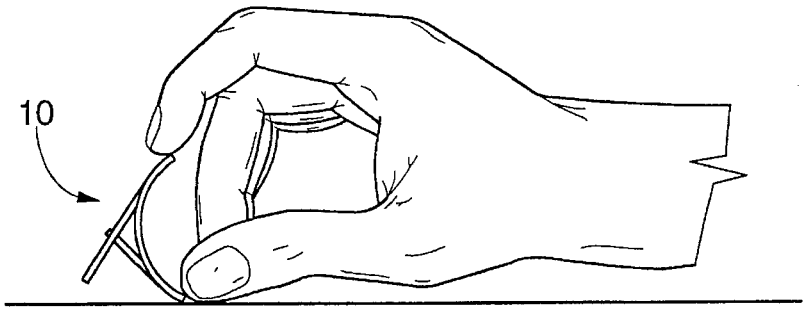
Figure 3C:
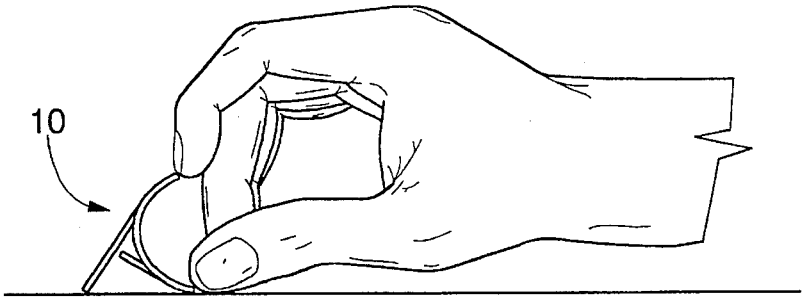
Figure 3D:
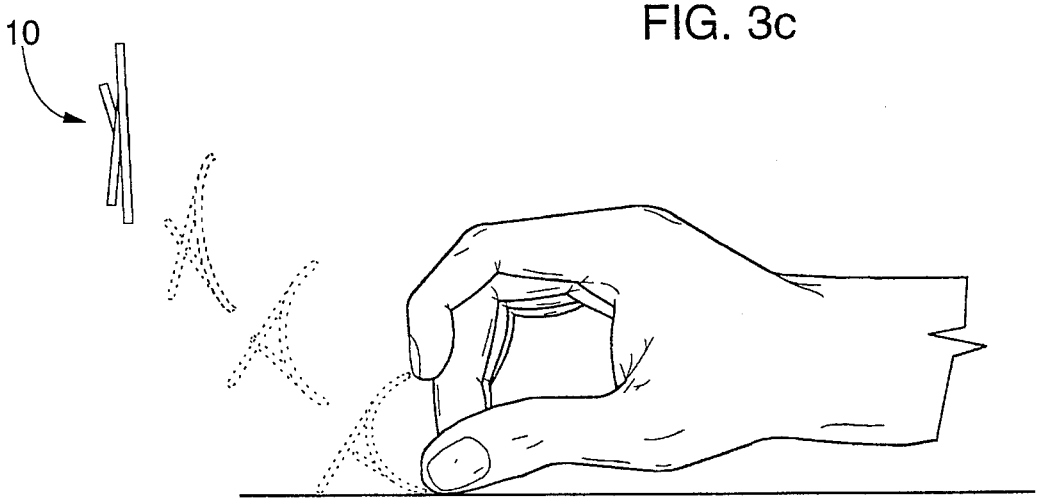
Figure 4:
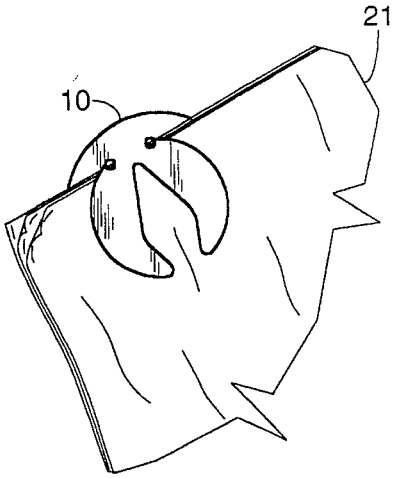
FIGS. 4–7 illustrate some of the many decorative, functional and novelty uses of the awesome jumpertops clipper disk 10, by way of example.
Figure 5:
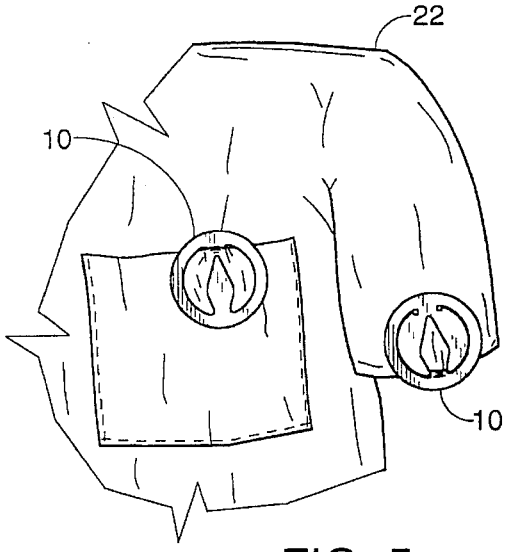
Figure 6:
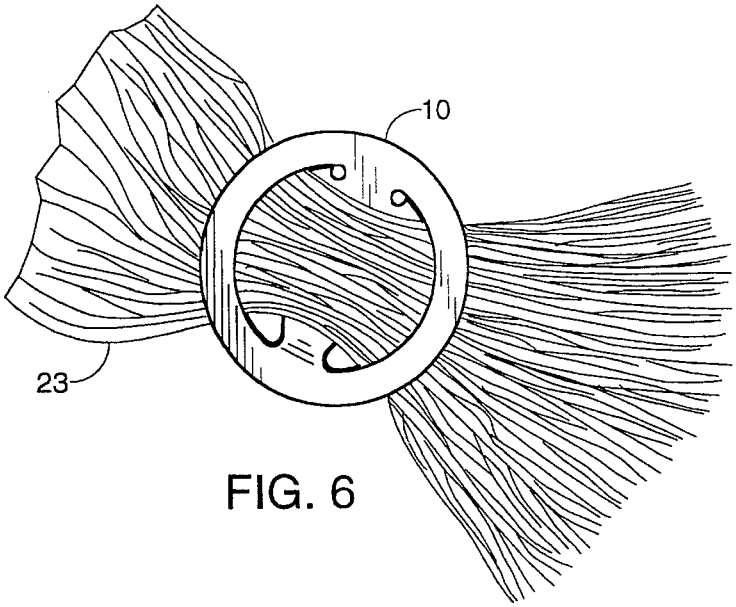
Figure 7:
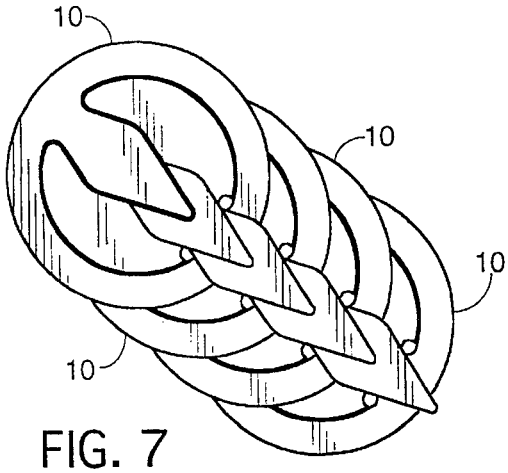

Step One—FIG. 2*a*—Aligning disk so that "wings" 14 of cut-through jumper pattern 11 point downwardly and the pointer 15 points upwardly, hold top and bottom edges 16 & 17 of disk 10 between thumb and forefinger, and place forefinger with bottom edge 17 of disk 10 on table or other surface;

Step Two—FIG. 2*b*—Bend top edge 16 of disk 10 backwardly and downwardly with thumb, while forefinger holds bottom edge 17 of disk 10 in place;

Step Three—FIG. 2*c*—Continue bending until "wings" 14 of disk 10 protrude forwardly and downwardly far enough to touch the table surface;

Step Four—FIG. 2*d*—As "wings" 14 touch table surface, allow top edge 16 of disk 10 to quick-release past thumbnail; and Step Five—Watch jumpertops clipper disk fly! With practice, a player will be able to aim the pointer 15, elevate the angle of the face, and vary the pressure and timing of quick-release in a manner to effect direction, height and distance of flight. With practice, a skill level will be achieved to direct the ballistics of jump-flight to hit a desired target 82. Thus the highest score will be achieved by the skilled player best able to manipulate and direct the jump-flight for target acquisition. Some players may prefer to jump-fly with the thumb down as in FIG. 3*a–d*, i.e. with the thumb holding the lower edge 17 on the table surface, and with the forefinger in the upper position, doing the bending and quick-release actions. Either position of the hand and thumb may be agreed upon by rules of the game. Likewise, at the option and agreement of players, any finger may equivalently be used for launching as in FIGS. 2*a–d* and 3*a–d* in place of the forefinger.

The Play of The Game

During Step One—FIG. 2*a*, place finger with bottom edge 17 of disk 10 on selected launch pad 81 of the game board;

During Steps 2 and 3—FIGS. 2*b* & c, "aim" the pointer 15 towards preferred target cups 82, adjusting disposition of hand, thumb, fingers, azimuth direction and elevation of position of jump-flight clipper disk 10, in best effort to direct jump-flight path into preferred targets 82, and to avoid hazards 83;

During quick-release of Step 4—FIG. 2*d*, continue aiming in best effort to direct flight of disk 10 into preferred target cup 82;

Each player, in turn, repeats steps 1 through 4 with each of his or her quantity of disks, preferably a total of ten (10) jump-flights.

Practice in jump-flight launching provides means for the player to acquire skill in aiming, directing and controlling the flight of the clipper disk 10 to accomplish target 82 acquisition, and whereby the more skilled player will achieve a higher score.

Scoring

Selection of launch pad area 81 determines the multiplier that will be applied to the target 82 score for that jump-flight. A jump-flight from #2 launch-pad 81 will yield a score 2 times whatever score is marked on the positive target 82, and equivalently negative hazard 83, that is hit. The players score each jump-flight in turn, positive or negative.

Winning Score.

Player, or team, which achieves the highest net score, offsetting positive scores with negative scores, is winner.

Collectible Attributes and Utilities.

As shown in FIGS. 4–7, the jump-flight clipper disk 10 is adapted to utilities desirable to game players. Because of the unique and novel design of the face pattern 11 forming two wings 14 and a pointer 15, the jump-flight clipper disk 10 will directly clip onto clothes as in FIG. 5, onto hair as in FIG. 6, and onto bluejeans, shirts, and dresses as in FIG. 5, for game and team identity and adornment of clothes, hair, notebooks, school paraphernalia, and other personal effects of the game player, and will directly clip onto school papers as in FIG. 4, and books as a paperclip as in FIG. 4, and is designed so that a plurality of clipper disks 10 can be linked together to form a chain as in FIG. 7 of colorful, identifiable collectible jumpertops clipper disks for novelty, for collection, and for game and team identity.

Equivalent Embodiments Included

Other shapes and arrangements are equivalently covered in this invention disclosure. While, the preferred embodiment of the clipper disk 10 has been disclosed as a substantially round disk with a face cut-out which forms two wings 14 and a pointer 15, the game board 80 as a rectangular shape, shaped target cups 82, and shaped hazards 83, it will be obvious that other body shapes can be equivalently used, within the scope of this disclosure, with equivalent results. For example, the jump-flight clipper disk 10 may be made in the shape of an octagon, or a hexagon; and the game board 80 may be round, semi-circular, triangular, or irregular shape, all being equivalently within the purview of this disclosure. Likewise, each target 82 and hazard 83 may be cups or compartments of any shape. The jump-flight release may be performed with the thumb down, or optionally with the thumb up; and equivalently, any finger may be used for launching in place of the forefinger, at players' agreement.

While only the preferred and some typical embodiments of this invention, have been illustrated in the accompanying drawings, and described in the Detailed Description, it will be understood that the invention is not limited to the embodiments disclosed, but is equally capable of numerous other equivalent arrangements, rearrangements, modifications and substitutions of parts and elements, equivalently to achieve the functions, means, way and results disclosed herein, without departing from the spirit and teaching of the invention, and are embodied in this invention.

What we claim is:

1. A jump-flight clipper disk and target game comprising in combination:

a game board and a plurality of jump-flight clipper disks;

said game board comprising: one or more launch areas from which said clipper disks may be launched; an array of one or more targets and one or more hazards where said clipper disks may land;

each said clipper disk adapted to jump-fly toward target areas of said game board when flexed, aimed and quick-released between thumb and finger of a player;

each said clipper disk further comprising: means for clipping on clothes for game identity and adornment; means for holding school papers as a paper clip; means for holding a lock of hair as a hair clip; and means for linking a plurality of said disks in sequence to form a chain of said disks.

2. A game according to claim 1 in which said launch areas are in a generally horizontal plane.

3. A game according to claim 1 in which said array of one or more targets and one or more hazards is on plane which may be inclined at an angle from horizontal plane so as to face generally at an angle toward said launch areas.

4. A game according to claim 1 in which said jump-flight clipper disks further comprise:

a coin shaped disk having a lower edge, an upper edge, two lateral edges, and a diametrical centerline extending from said lower edge of said disk to said upper edge;

a pattern cut-through the thickness of the body of said disk, located in the central portion of the face of said disk;

said pattern being symmetrical about said centerline;

said pattern forming two wings, one on each side of said centerline, extending toward said lower edge of said disk, and further forming a pointer shape between said wings, extending symmetrically along said centerline and pointing toward said upper edge of said disk;

said disk having an uninterrupted periphery;

said disk being adapted so that, when said disk is held between finger and thumb of a player and said upper edge is flexed between thumb and finger backwardly and downwardly in a position toward said lower edge, deflection of said disk is in said two lateral edges of said periphery of said disk, said wings are extended forwardly and downwardly, and said pointer shape is extended forwardly and upwardly; and so that when said upper edge is quick-released, allowing said disk to return to a neutral position, said clipper disk will jump-fly through the air.

5. A jump-flight clipper disk according to claim 4 in which said clipper disk is made of homogeneous, flexible, resilient, plastic type material having substantially parallel top and bottom faces, and a diameter-to-thickness ratio of between 30 and 50.

6. A jump-flight clipper disk according to claim 5 further comprising a contoured thickness.

7. A coin shaped game piece which, when flexed between thumb and finger, aimed and instantly released, jumps forth as an aimed, self propelled projectile, comprising:

a coin shaped disk;

said disk comprising flexible, resilient material having substantially parallel top and bottom planar surfaces;

said disk comprising an uninterrupted periphery, a vertical diameter, invisible vertical and horizontal diametrical centerlines, upper and lower edges located on said periphery at upper and lower ends of said vertical centerline, an upper peripheral portion surrounding said upper edge, a lower peripheral portion surrounding said lower edge, a central portion, a righthand lateral peripheral portion, and a lefthand lateral peripheral portion;

a pattern cut through said disk and confined within said uninterrupted periphery;

said cut symmetrical about said vertical centerline, separating said righthand and lefthand lateral peripheral portions from said central portion, and further separating said central portion into an upper central part and a lower central part;

said upper central part extending downwardly from said upper edge a distance of at least 60% of said vertical diameter, and said lower central part extending upwardly from said lower edge a distance of at least 60% of said vertical diameter;

said disk, except for said cut, symmetrical about said vertical and horizontal centerlines.

8. A game piece according to claim 7 further comprising:

said disk comprising means for jumping forward; and said disk further comprising means for aiming the direction, elevation and distance of flight of said disk for said jump as an aimed, self-propelled projectile.

9. A game piece according to claim 8 wherein said means for jumping forward comprises;

each said lateral peripheral portion comprising a bendable, resilient shaft connecting said upper peripheral portion to said lower peripheral portion, and each said shaft comprising material of proper width, thickness and flexibility to permit said disk to be flexed between thumb and finger backwardly a total of at least forty-five degrees, displacing said upper edge toward said lower edge, and said material of proper resilience to store sufficient potential energy in said shaft during said flexing to cause said disk to spring forward as a self-propelled projectile when instantly released from said flexing.

10. A game piece according to claim 8 wherein said means for aiming comprises;

said lower central part shaped by said symmetrical cut to form a pointer, attached to said lower peripheral portion, and extending upwardly along said vertical centerline toward said upper peripheral portion, wherein said pointer is aimed forwardly during said flexing; and said upper central part shaped by said symmetrical cut to form a pair of wings attached to said upper peripheral portion, located one on each side of said pointer, and extending downwardly toward said lower peripheral portion, wherein said wings are aimed forwardly during said flexing.

11. A game piece according to claim 7 further comprising one or more ends of said cut terminating in a rounded opening wider than said cut wherein stress concentration in said cut end is minimized.

12. A game piece according to claim 7 further comprising at least one of said planar surfaces being contoured.

13. A coin shaped game piece which, when flexed between thumb and finger, aimed and instantly released, jumps forth as an aimed, self-propelled projectile, comprising:

a coin shaped disk;

said disk comprising flexible, resilient material having substantially parallel top and bottom planar surfaces;

said disk comprising an uninterrupted periphery, a vertical diameter, invisible vertical and horizontal diametrical centerlines, upper and lower edges located on said periphery at upper and lower ends of said vertical centerline, an upper peripheral portion surrounding said upper edge, a lower peripheral portion surrounding said lower edge, a central portion, a righthand lateral peripheral portion, and a lefthand lateral peripheral portion;

a pattern cut through said disk and confined within said uninterrupted periphery;

said cut symmetrical about said vertical centerline, separating said righthand and lefthand lateral peripheral portions from said central portion, and further separating said central portion into an upper central part and a lower central part;

said disk, except for said cut, symmetrical about said vertical and horizontal centerlines;

said disk further comprising means for jumping forward, comprising;

each said lateral peripheral portion comprising a bendable, resilient shaft connecting said upper peripheral portion to said lower peripheral portion, and each said shaft comprising material of proper width, thickness and flexibility to permit said disk to be flexed between thumb and finger backwardly a total of at least forty-five degrees, displacing said upper edge toward said lower edge, and said material of proper resilience to store sufficient energy in said shaft during said flexing to cause said disk to spring forward as a self-propelled projectile when instantly released from said flexing;

said disk further comprising means for aiming the direction, elevation and distance of flight of said disk during flexing for said jump as an aimed, self-propelled projectile, comprising;

said lower central part shaped by said symmetrical cut to form a pointer, attached to said lower peripheral portion, and extending upwardly along said vertical centerline toward said upper peripheral portion, wherein said pointer is aimed forwardly during said flexing; and said upper central part shaped by said symmetrical cut to form a pair of wings attached to said upper peripheral portion, located one on each side of said pointer, and extending downwardly toward said lower peripheral portion, wherein said wings are aimed forwardly during said flexing;

said wings extending downwardly from said upper edge a distance of at least 60% of said vertical diameter, and said pointer extending upwardly from said lower edge a distance of at least 60% of said vertical diameter.

* * * * *